United States Patent [19]

Hauser et al.

[11] 4,093,457

[45] June 6, 1978

[54] METHOD OF TRANSFER

[75] Inventors: Oscar G. Hauser, Rochester; Kallis H. Mannik, Webster; Charles A. Whited, Rochester, all of N.Y.

[73] Assignee: Xerox Corporation, Stamford, Conn.

[21] Appl. No.: 694,853

[22] Filed: Jun. 10, 1976

[51] Int. Cl.[2] ..... G03G 13/01; G03G 13/08

[52] U.S. Cl. ..... 96/1.2; 427/24; 118/645; 355/4

[58] Field of Search ..... 355/4, 3 DD, 3 TR; 96/1.2, 1 SD, 1.4; 118/645, 658; 427/24

[56] References Cited

U.S. PATENT DOCUMENTS

| | | | |
|---|---|---|---|
| 3,815,988 | 6/1974 | McVeigh et al. | 355/3 DD |
| 3,909,259 | 9/1975 | Mammino et al. | 96/1.2 |

*Primary Examiner*—L. T. Hix

*Assistant Examiner*—W. J. Brady

*Attorney, Agent, or Firm*—J. J. Ralabate; C. A. Green; H. Fleischer

[57] ABSTRACT

A color process in which color copies of an original document containing color information are reproduced. Successive single color electrostatic latent images are developed with particles having a predetermined triboelectric charge thereon. These particles are transferred from the single color electrostatic latent images to a sheet of support material in a prescribed sequence. The sequence of transfer is such that each successive layer of toner particles transferred to the sheet of support material has a lesser triboelectric charge thereon than the preceeding layer transferred thereto. In this manner, back transfer from the sheet of support material to the electrostatic latent image is minimized.

5 Claims, 3 Drawing Figures

METHOD OF TRANSFER

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an apparatus for transferring successive layers of toner particles to the sheet of support material in a prescribed sequence.

In the process of electrophotographic printing, a photoconductive surface is uniformally charged and exposed to a light image of an original document. Exposure of the photoconductive surface creates an electrostatic latent image corresponding to the original document. Toner particles are then deposited on the latent image rendering it visible. Subsequently, the toner powder image is transferred to a sheet of support material and permanently affixed thereto producing a copy of the original document. The foregoing process is described more fully in U.S. Pat. No. 2,297,691 issued to Carlson in 1942.

Multi-color electrophotographic printing is substantially identical to the heretofore discussed process of black and white printing. However, rather than forming a white light image of the original document, the light image is filtered producing a single color light image thereof. The single color light image exposes the charged photoconductive surface to record thereon a single color electrostatic latent image. The single color electrostatic latent image is developed with toner particles of a color complementary to the single color light image. The single color toner powder image is then transferred from the electrostatic latent image to a sheet of support material. This process is repeated a plurality of cycles for differently colored light images and the respective complementarily colored toner particles. Each single color toner powder image is transferred to the sheet of support material in superimposed registration with the prior toner powder image. This creates a multi-layered toner powder image on the sheet of support material. Thereafter, the multi-layered toner powder image is permanently affixed to the sheet of support material creating a color copy corresponding substantially to the colored original document being reproduced.

Hereinbefore, toner powder images have been transferred to the sheet of support material by an electric field created by a corona generator of a type disclosed in U.S. Pat. No. 2,836,725 issued to Vyverberg in 1958. A corona generator of this type induces transfer to the sheet of support material by spraying a corona discharge having a polarity opposite to that of the toner particles on the photoconductive surface. This causes the toner particles to be electrically transferred to the sheet of support material. This type of corona generator has proven to be extremely reliable for transferring a single toner powder image to a sheet of support material. However, such a corona generator does not readily lend itself to transferring multiple toner powder images, in superimposed registration with one another, as is required in color electrophotographic printing.

Other techniques utilized have included an electrically biased transfer roll. The bias transfer roll generates a high voltage discharge in the proximity of the surface of the paper, or it may be applied by means of a conductive cylinder in contact with the paper, as disclosed in U.S. Pat. No. 2,807,233 issued to Fitch in 1957. As taught therein, a sheet of support material is interposed between the conductive roller and surface having the toner powder image thereon. A charge of opposite polarity from the toner particles is deposited on the backside of the sheet of support material which attracts the toner powder image thereto.

Basically, irrespective of the exact mechanism employed to achieve transfer of the toner particles from the latent image, the characteristics of the toner particles and the electrical field determine the quality of the transferred image. In particular, the toner particles have a triboelectric charge thereon and transfer is effected via an electrical field attracting the triboelectrically charaged toner particles from the latent image to the sheet of support material. Many factors influence the quality of the transferred image, the most significant factors being those which affect the uniformity with which the toner powder image is transferred from the photoconductive surface to the sheet of support material. Heretofore, the process of transferring multi-layered toner powder images, as exemplified by a colored electrophotographic printing machine, has produced various problems. In particular, when an electrically biased transfer roll is employed to transfer successive toner powder images, in superimposed registration, to a sheet of support material, hollow characters frequently occur. Hollow characters may be defined as a toner area wherein substantially only the periphery thereof is transferred while the central portion remains devoid of toner particles. The problem of hollow characteristics is most pronounced on line copy reproduction. However, hollow characters frequently occur in solid area copy as well. It has been found that not only does the failure of the toner particles to initially transfer cause the problem of hollow characters, but, frequently, the toner particles back transfer from the sheet of support material to the latent image. This back transfer problem has proven to be one of the most significant causes of poor image quality.

Accordingly, it is a primary object of the present invention to improve transfer in electrophotographic printing by minimizing back transfer of the toner particles from the sheet of support material to the photoconductive surface.

SUMMARY OF THE INVENTION

Briefly stated, and in accordance with the present invention, there is provided an electrophotographic printing machine for reproducing copies from an original document.

This is achieved, in the present instance, by an electrophotographic printing machine employing means for charging at least a portion of a photoconductive member to a substantially uniform level. Means are provided for exposing the charged portion of the photoconductive member to successive light images. This records successive electrostatic latent images on the photoconductive member. A plurality of developer units are used in the printing machine. Each developer unit brings toner particles having a preselected triboelectric charge thereon into operative communication with an electrostatic latent image recorded on the photoconductive member. This renders the latent image visible. Means transfer the toner particles from successive electrostatic latent images to a sheet of support material in a prescribed sequence. The sequence is such that each successive layer of toner particles transferred to the sheet of support material has a decreasing triboelectric charge thereon. This minimizes back transfer of the toner particles from the sheet of support material to the latent image.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment and method of use thereof, it will be understood that it is not intended to limit the invention to that embodiment or method of use. On the contrary, it is intended to cover all alternatives, modifications and equivalents as may be included within the spirit and scope of the invention as defined by the appended claims.

DETAILED DESCRIPTION OF THE INVENTION

Figure 1:
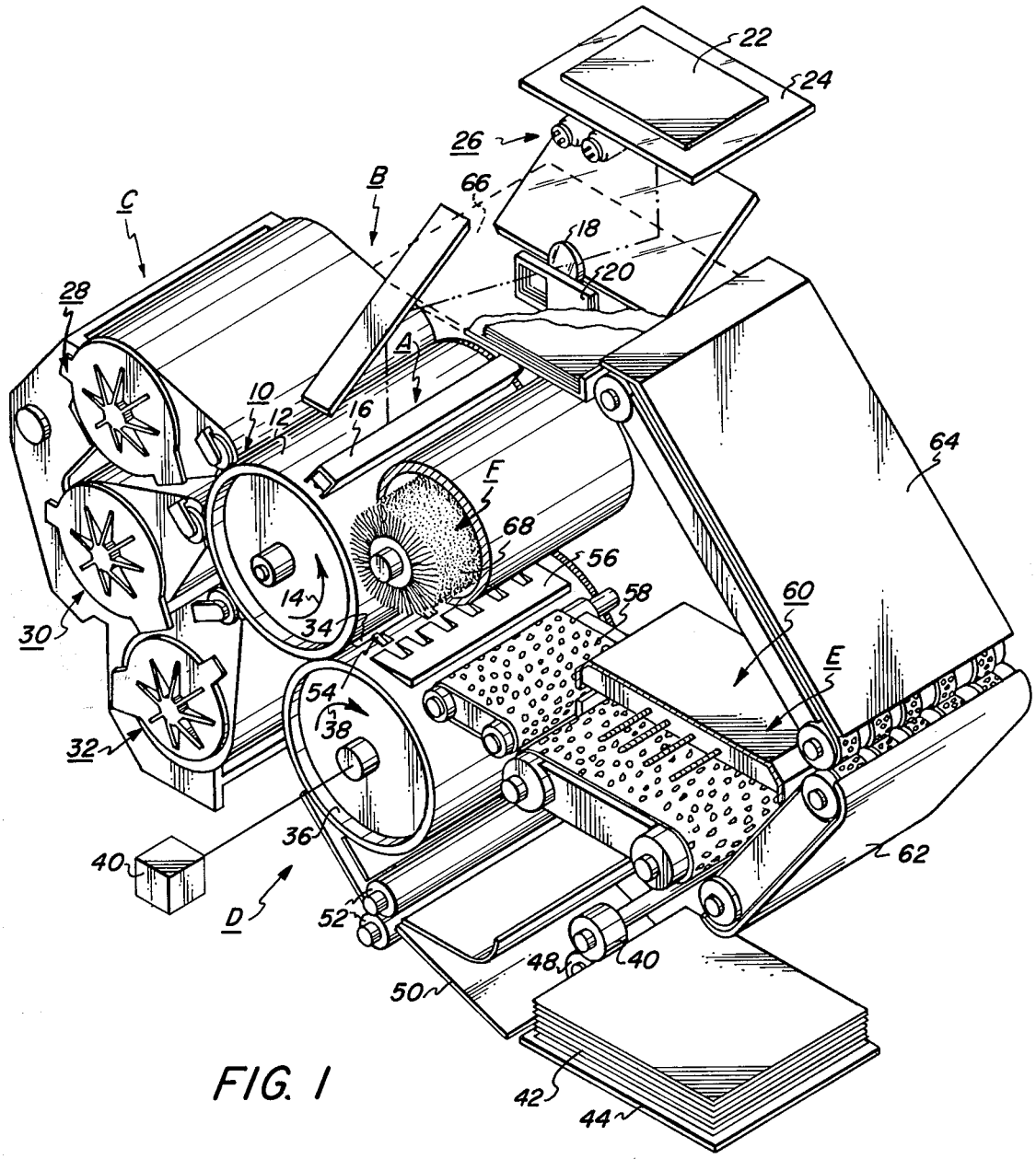
FIG. 1 is a schematic perspective view depicting an electrophotographic printing machine incorporating the features of the present invention therein.

For a general understanding of an electrophotographic printing machine incorporating the features of the present invention therein, continued reference is had to the drawings wherein like reference numerals have been used throughout to designate identical elements. FIG. 1 schematically illustrates the various components of a printing machine for producing color copies from a colored original document. Although the transfer apparatus of the present invention is particularly well adapted for use in an electrophotographic printing machine, it should become evident from the following discussion that it is equally well suited for use in a wide variety of electrostatographic printing machines and is not necessarily limited in its application to the particular embodiment shown herein.

The process employed in color electrophotographic printing, as shown in FIG. 1, is a subtractive color-to-color reproducing process. In this process, toner particles having colorants containing the subtractive primaries cyan, magenta and yellow are employed to provide a wide range of colors found in the original document on the color copy. The first step in producing a color copy is to ascertain the color composition of the original subject matter and to record this information on a photoconductive member. The color original document is optically scanned a number of times to record successive electrostatic latent images on the photoconductive member. Each light image is passed through a color filter to form a color separated electrostatic latent image. The electrostatic latent image created by passing the light through a filter is developed by toner particles containing colorants complementary in color thereto. Areas of relatively high charge density on the photoconductive member indicate the absence of the filtered light, whereas areas of relatively low charge density indicate the presence of the filtered light in the colored original document. For example, the electrostatic latent image formed by passing the light image through a green filter will record the magentas as areas of relatively high charge density on the photoconductive member while the green light rays will cause the charge density thereon to be reduced to a level ineffective for development. The magentas are then made visible by applying toner particles containing a green absorbing, i.e., magenta, colorant to the electrostatic latent image recorded on the photoconductive member. Similarly, a blue separation is developed with toner particles containing a yellow pigment, while a red separation is developed with toner particles containing a cyan colorant. The three developed color separated toner powder images are then brought together, in registration, on a sheet of support material to produce the resultant multicolor copy which corresponds to the original colored document.

Referring now to FIG. 1, the detailed structural configuration of the electrophotographic printing machine employing the process heretofore described will be now discussed. Electrophotographic printing machines utilize a photoconductive member having a drum 10 with a photoconductive surface 12 secured to and entrained about the exterior circumferential surface thereof. Preferably, photoconductive surface 12 is made from a material having a relatively panchromatic response to white light. One type of suitable photoconductive material is disclosed in U.S. Pat. No. 3,655,377 issued to Sechak in 1972. Drum 10 is mounted rotatably within the printing machine on a shaft secured to the frame of a machine. As drum 10 rotates in the direction of arrow 14, portions thereof pass through a series of processing stations disposed about the periphery thereof. A signal generator is mounted on drum 10 and cooperates therewith to sequentially activate each of the processing stations so that the proper cycle of events occurs.

For purposes of the present disclosure, each of the processing stations employed in the electrophotographic printing machine illustrated in FIG. 1 will be briefly described hereinafter.

As drum 10 rotates in the direction of arrow 14, photoconductive surface 12 passes through charging station A. Charging station A includes a corona generating device, indicated generally by the reference numeral 16. Corona generating device 16 charges at least a portion of photoconductive surface 12 to a substantially uniform level. One type of suitable corona generating device is described in U.S. Pat. No. 3,875,407 issued to Hayne in 1975.

Thereafter, drum 10 rotates the charged portion of photoconductive surface 12 to exposure station B. At exposure station B, a filtered light image of the original document is projected onto the charged portion of photoconductive surface 12. A moving lens system, generally designated by the reference numeral 18, and a color filter mechanism, shown generally at 20, move in a timed relationship with drum 10 to scan successive incremental areas of original document 22 disposed upon transparent platen 24. Lamps 26, located beneath platen 24, illuminate successive incremental areas of original document 22. A suitable moving lens system is described in U.S. Pat. No. 3,062,108 issued to Mayo in 1952. Similarly, U.S. Pat. No. 3,775,006 issued to Hartman et al. in 1973 discloses a suitable filter mechanism. Finally, U.S. Pat. No. 3,592,531 issued to McCrobie in 1971 discloses a suitable type of lens. The foregoing elements cooperate with one another to produce a single color flowing light image of the original document which is projected onto the changed portion of photoconductive surface 12 selectively dissipating the charge thereon to record a single color electrostatic latent image.

After the electrostatic latent image is recorded on photoconductive surface 12, drum 10 rotates the latent image to development station C. At development station C, three individual developer units, generally indicated by the reference numerals 28, 30 and 32, respectively, render successive electrostatic latent images visible. A suitable development station for use in a color electrophotographic printing machine is disclosed in U.S. Pat. No. 3,854,449 issued to Davidson in 1974. Each of the developer units described therein are of a type referred to in the art as "magnetic brush developer units". In general, a magnetic brush developer unit employs a developer mix of ferromagnetic carrier granules having toner particles triboelectrically attracted thereto. The triboelectric charge on the toner particles is variable and may be adjusted. For example, the triboelectric characteristics can be changed by coating the carrier granules with a resin selected to provide the proper polarity and magnitude of electrical charge on the toner particles. Each developer unit forms a directional flux field to continually create a magnetic brush of developer mix. This brush of developer mix is brought into contact with the latent image recorded on photoconductive surface 12. Toner particles are attracted from the carrier granules to the latent image by the greater electrostatic force thereof. Thus, the latent image is developed or rendered visible by the toner particles. Developer units 28, 30 and 32, respectively, contain differently colored toner particles. Each of the toner particles contained in the respective developer unit correspond to the complement of the single color light image transmitted through each of the differently colored filters of filter mechanism 20. As an illustration, a latent image formed by a green filtered light image is developed with green absorbing magenta toner particles. Similarly, latent images formed by blue and red images are developed with yellow and cyan toner particles, respectively.

With continued reference to FIG. 1, drum 10 is next rotated to transfer station D where the toner powder image adhering electrostatically to photoconductive surface 12 is transferred to a sheet of support material 34. Support material 34 may be plain paper or a sheet of thermoplastic material, amongst others. Transfer station D includes a transfer member, designated generally by the reference numeral 36. Preferably, transfer member 36 is a roll adapted to rotate in the direction of arrow 38 to recirculate support material 34 therewith. Variable power supply 40 electrically biases transfer roll 36 to a preselected voltage level. This potential is of sufficient magnitude and polarity to electrostatically attract the toner particles from the electrostatic latent image recorded on photoconductive surface 12 to support material 34. Transfer roll 36 rotates in synchronism with drum 10 enabling successive toner powder images to be transferred to sheet 34 in registration with one another. Drum 10 and transfer roll 36 rotate at the same tangential velocity. A suitable electrically biased transfer roll is described in U.S. Pat. No. 3,612,677 issued to Langdon et al., in 1971. The detailed operation of transfer station D and the sequence of toner particle transfer will be discussed hereinafter, in greater detail, with reference to FIGS. 2 and 3.

Prior to proceeding with a description of the remaining processing stations, the sheet feeding path will be briefly described. Support material 34 is advanced from a stack 42 disposed upon a tray 44. Feed roll 40, in operative communication with retard roll 48, separates and advances the uppermost sheet from stack 42. The sheet moves into chute 50 which directs it into the nip between register rolls 52. Register rolls 52 align and forward the advancing sheet, in synchronism with the movement of transfer roll 36. Gripper fingers 54, mounted on transfer roll 36, receive sheet 34 and secure it releasably thereon. After the requisite number of toner powder images have been transferred to sheet 34, gripper fingers 54 space sheet 34 from transfer roll 36. As transfer roll 36 continues to rotate, stripper bar 56 is interposed between sheet 34 and transfer roll 36. Sheet 34 moves over stripper bar 56 onto conveyor 58. Endless belt conveyor 58 advances sheet 34 to fixing station E.

At fixing station E, a fuser, indicated generally by the reference numeral 60, supplies sufficient heat to permanently affix the toner powder images transferred to sheet 34 thereto. One type of suitable fusing apparatus is described in U.S. Pat. No. 3,907,492 issued to Draugelis et al. in 1975. After the fusing process, sheet 34 is advanced by endless belt conveyors 62 and 64 to catch tray 66 for subsequent removal therefrom by the machine operator.

Invariably, after the transfer process, residual toner particles remain adhering to photoconductive surface 12. These residual toner particles are removed from photoconductive surface 12 at cleaning station F. Cleaning station F, the final processing station in the direction of rotation of drum 10, includes a pre-clean corona generating device (not shown) for neutralizing the charge on photoconductive surface 12 and that of the residual toner particles. This enables fibrous brush 68, in contact with photoconductive surface 12, to remove the residual toner particles therefrom. A suitable brush cleaning system is described in U.S. Pat. No. 3,590,412 issued to Gerbasi in 1971.

It is believed that the foregoing description is sufficient for purposes of the present application to depict the general operation of an electrophotographic printing machine embodying the teachings of the present invention therein.

Figure 2:
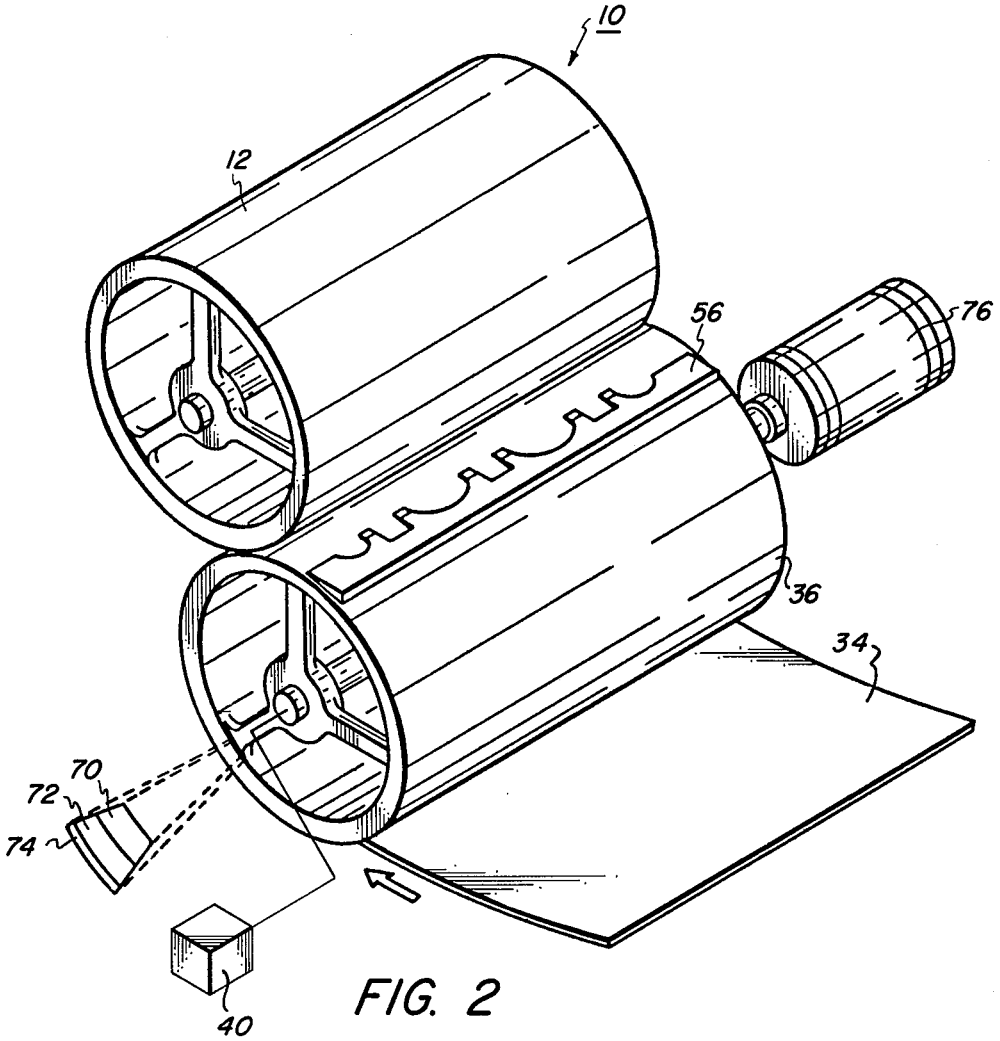
FIG. 2 is a schematic perspective view illustrating the transfer apparatus employed in the FIG. 1 printing machine.

Turning now to the specific subject matter of the present invention, FIG. 2 depicts transfer roll 36 associated with photoconductive surface 12 of drum 10. Transfer roll 36 includes an aluminum tube 70, preferably having a ¼ inch thick layer of urethane 72 cast thereabout. A polyurethane coating 74, preferably of about 1 mil thick, is sprayed over the layer of cast urethane 72. Preferably, transfer roll 36 has a durometer hardness range from about 10 units to about 30 units on the Shore A scale. The resistivity of transfer roll 36, preferably, ranges from about $10^8$ to about $10^{22}$ ohm/centimeters. Variable voltage source 40 applies a direct current bias voltage to aluminum tube 70 by suitable means such as a carbon brush and brass ring assembly (not shown). The voltage applied to roll 36 may range from about 1,000 to about 5,000 volts, being preferably about 2,000 volts. Contact between photoconductive surface 12 of drum 10 and transfer roll 36, with support material 34 interposed therebetween, is preferably limited to a maximum of about 1.0 pound force per linear inch. A synchronous speed main drive motor rotates transfer roll 36. The drive is coupled to transfer roll 36 by a flexible metal bellows 76 which permits the lowering and raising of transfer roll 36. Synchronization of transfer roll 36 and drum 10 is achieved by precision gears (not shown) coupling the main drive motor to both transfer roll 36 and drum 10. The toner particles transferred from photoconductive surface 12 to sheet 34 on transfer roll 36 are in an ordered sequence. By this, it is meant that the second layer of toner particles transferred to the sheet of support material has a lower triboelectric charge thereon than the first layer of toner particles transferred thereto. In this manner, back transfer, i.e., transfer from the sheet of support material back to the photoconductive surface, is minimized.

Figure 3:
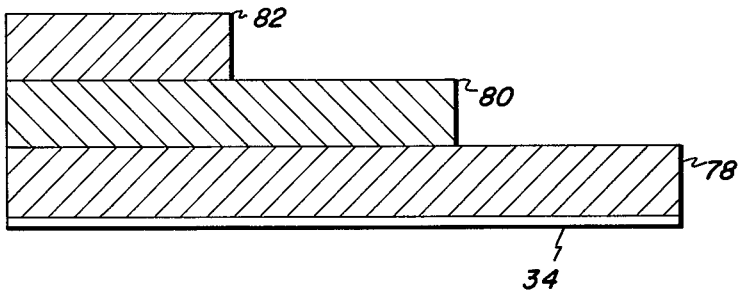
FIG. 3 is a graphic representation diagramatically showing the characteristics typifying the transfer of three layers of toner particles by the FIG. 2 transfer apparatus.

Referring now to FIG. 3, there is shown a sheet of support material 34 with a multi-layered toner powder image transferred thereto. By way of example, if the first layer of toner particles 78 is yellow, it will have a triboelectric charge of about 44$\mu$ coulombs/gram, the second layer 80, cyan, will have a triboelectric charge of about 20$\mu$ coulombs/gram, and the third layer 82, magenta, will have a triboelectric charge of 6$\mu$ coulombs/gram. In this way, back transfer from the sheet of support material to the photoconductive surface is minimized. Contrawise, if the sequence of transfer is reversed, i.e., the first layer transferred to sheet 34 having a minimum triboelectric charge and the last layer a maximum triboelectric charge, the effect of back transfer will be maximized, i.e., an undesirable result. Hence, it has been found that back transfer will be minimized by controlling the triboelectric charge of the toner particles such that each successive layer of toner particles transferred to the sheet of support material will have a lesser triboelectric charge than the previously transferred layer of toner particles.

One skilled in the art will appreciate that the colorant or color of the toner particles need not have any relationship to the triboelectric charge. Thus, the triboelectric charge of the toner particles may be suitably adjusted so as to transfer the toner particles in any color order, the only constraint being that the triboelectric charge should decrease for each successive layer transferred thereto.

In recapitulation, it is apparent that the transfer apparatus of the present invention minimizes back transfer by ordering the sequence of transfer of toner particles from the photoconductive surface to the sheet of support material. This order is such that each successive layer of toner particles transferred from the photoconductive surface to the sheet of support material has a triboelectric charge equal to or less than the layer of toner particles transferred previously thereto. The method and apparatus heretofore described is adapted to minimize back transfer from the sheet of support material to the photoconductive surface. It automatically corrects for hollow characters and insures a substantially uniform, high fidelity copy.

It is, therefore, evident that there has been provided in accordance with the present invention, a transfer apparatus and method of sequentially transferring successive layers of toner particles that fully satisfy the objects, aims and advantages hereinbefore set forth. While this invention has been described in conjunction with a specific embodiment and method of use thereof, many alternatives, modifications and variations will be evident to those skilled in the art. Accordingly, it is intended to embrace all such alternatives, modifications and variations as fall within the spirit and broad scope of the appended claims.

What is claimed is:

1. A method of producing a copy, including the steps of:

recording successive electrostatic latent images on a member;

developing each successive electrostatic latent image with particles having differing triboelectric charges; and transferring the particles from the successive electrostatic latent images to a sheet of support material in a pre-determined sequence wherein each successive layer of particles transferred to the sheet of support material has a decreasing triboelectric charge, thereby minimizing back transfer from the sheet of support material to the electrostatic latent image.

2. A method as recited in claim 1, wherein each transferred layer of particles is of a different color wherein the colors are arranged to mix subtractively with one another to produce a pre-determined resultant color.

3. A method as recited in claim 1, further including the step of fixing the transferred particles to the sheet of support material.

4. A method as recited in claim 1, wherein the step of recording includes the steps of:

charging at least a portion of a photoconductive member;

creating a light image of the original document to be reproduced;

filtering the light image to create successive single color light images containing a discrete color of the original document; and projecting successive single color light images onto the charged portion of the photoconductive member to record successive single color electrostatic latent images thereon.

5. A method as recited in claim 4, wherein said step of developing includes the step of depositing on each single color electrostatic latent image particles containing a color complementary in color to the color of the single color light image projected onto the charged photoconducitve member for rendering visible the corresponding single color electrostatic latent image recorded thereon.

* * * * *